US005866973A

United States Patent [19]

Kagawa et al.

[11] Patent Number: 5,866,973

[45] Date of Patent: Feb. 2, 1999

[54] SPARK PLUG HAVING A PLATINUM TIP ON AN OUTER ELECTRODE

[75] Inventors: Junichi Kagawa; Wataru Matsutani, both of Nagoya, Japan

[73] Assignee: NGK Spark Plug Co., Ltd., Nagoya, Japan

[21] Appl. No.: 915,063

[22] Filed: Aug. 20, 1997

Related U.S. Application Data

[63] Continuation of Ser. No. 383,920, Feb. 6, 1995, abandoned, which is a continuation-in-part of Ser. No. 897,888, Jun. 12, 1992, abandoned.

[30] Foreign Application Priority Data

Apr. 30, 1991 [WO] WIPO ..... PCT/JP91/00059

[51] Int. Cl.[6] ..... H01T 13/20; H01T 13/22; H01T 13/34; H01T 13/36

[52] U.S. Cl. ..... 313/141; 313/142; 313/144

[58] Field of Search ..... 313/141, 141.1, 313/142, 144, 352, 355; 123/169 R, 169 EI

[56] References Cited

U.S. PATENT DOCUMENTS 2,001,888 5/1935 Randolph et al. ..... 313/141 X 4,581,558 4/1986 Takamura et al. ..... 313/141

4,970,426 11/1990 Bronchart ..... 313/141

5,210,457 5/1993 Oshima et al. ..... 313/141 X

*Primary Examiner*—Sandra O'Shea

*Assistant Examiner*—Mack Haynes

*Attorney, Agent, or Firm*—Donald S. Dowden; Cooper & Dunham LLP

[57] ABSTRACT

A spark plug is provided having a center electrode disposed in a metallic shell through an insulator so that the front end of the center electrode forms a spark gap with an outer electrode. A platinum tip is secured to the outer electrode positioned to oppose the front end of the center electrode. The outer electrode is provided with a heat-conductive core metal cladded with a matrix metal which is made of a nickel-based alloy containing 10–20 wt. % chromium. The platinum tip is welded to the outer electrode to form a welded portion between the platinum tip and the outer electrode and the platinum tip is positioned to terminate slightly short of the core metal so that the distance between a circumferential edge of the welded portion and a front end of the core metal is in the range 0.0 mm–2.0 mm measured lengthwise along direction the outer electrode.

5 Claims, 4 Drawing Sheets

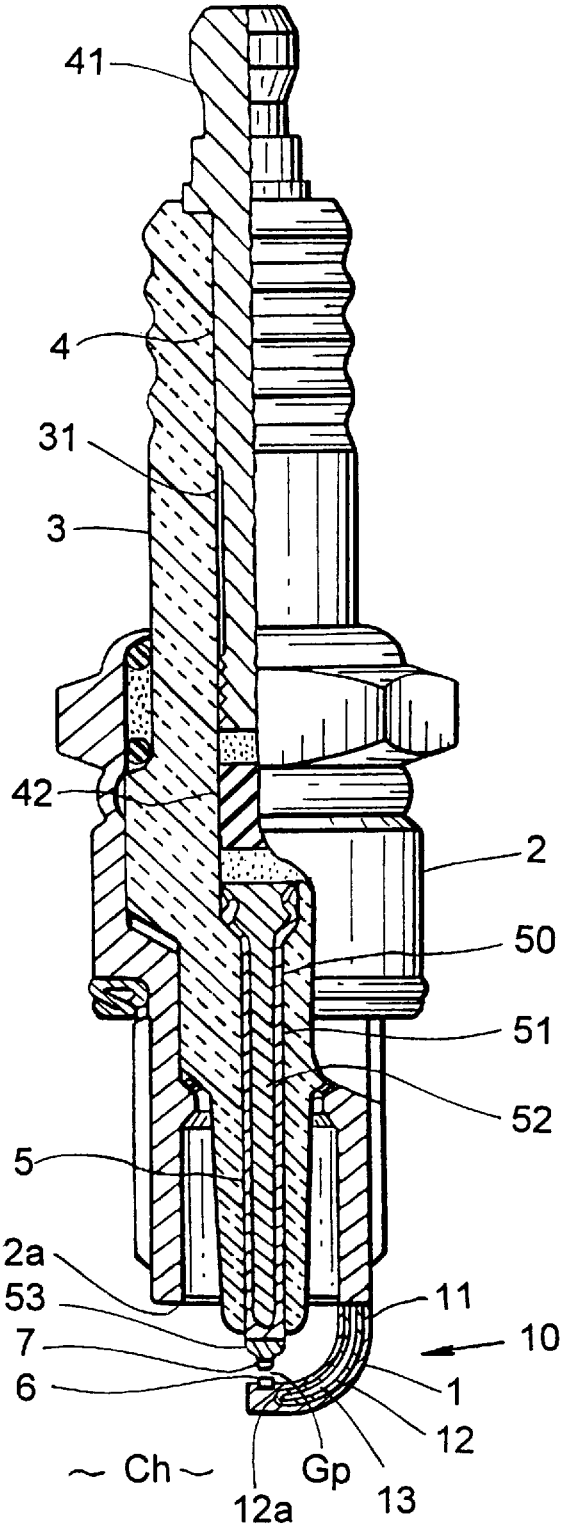
FIG. 1
FIG. 1a
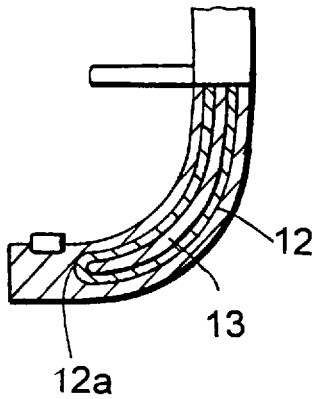

SPARK PLUG HAVING A PLATINUM TIP ON AN OUTER ELECTRODE

This is a continuation of application Ser. No. 08/383,920, filed Feb. 6, 1995, now abandoned, which was a continuation-in-part of application Ser. No. 07/897,888, filed Jun. 12, 1992, now abandoned.

FIELD OF THE INVENTION

This invention relates to a spark plug having a platinum tip welded to an outer electrode, and particularly concerns an improvement intended to avoid deterioration of the weld between the tip and the outer electrode.

The recent requirements of purifying the emission gases and enhancing fuel consumption of an internal combustion engine, have brought about the need to run the engine with a leaner gasoline mixture. Because of the resulting higher temperature of the combustion chamber, the outer electrode of the spark plug becomes exposed to a high temperature.

For operating an engine more than 100,000 km without replacing the spark plug, it has been suggested that the outer electrode be made of a copper core cladded with a nickel-alloy matrix, with a platinum tip is welded opposite ends of both outer and center electrodes so as to improve oxidation and corrosion resistance. Compared to the center electrode, the outer electrode is exposed to a higher temperature such that the platinum tip tends to fall off the outer electrode at the weld.

In an extension-type spark plug in which the firing end of the spark plug is extended into the combustion chamber, the outer electrode is even more exposed to higher temperatures and then cooled by the introduced gasoline mixture. As a result thermal stress occurs at the welded portion between the tip and the outer electrode so that the tip is liable to fall off the outer electrode.

Accordingly, it is an object of this invention to provide a spark plug having a platinum tip welded to the outer electrode and capable of reducing and resisting thermal stress between the platinum tip and the outer electrode, thus contributing to increased service life.

SUMMARY OF THE INVENTION

According to this invention, there is provided a spark plug comprising a center electrode disposed in a metallic shell through an insulator so that the front end of the center electrode forms a spark gap with an outer electrode extended from the metallic shell. A platinum tip is secured to the outer electrode and positioned in a manner to oppose the front end of the center electrode. The outer electrode is provided with a heat-conductive core metal cladded with a matrix metal which is made of nickel-based alloy containing 10–20 wt. % chromium. The platinum tip is welded to the outer electrode and the tip is positioned to terminate slightly short of the core metal so that the distance between the circumference of the welded portion and the front end of the core metal falls within a distance in the range 0.0–2.0 mm.

As a result of this arrangement between the platinum tip and the core metal, a significant amount of heat is uniformly evenly dissipated from a front end of the outer electrode to the metallic shell by way of the core metal, thereby avoiding too high a temperature at the front end of the outer electrode and reducing thermal stress at the welded portion between the tip and the outer electrode, at the same time reducing oxidation of the welded portion so as to avoid the tip from falling off the outer electrode.

When the welded portion is positioned to partly overlap the front end of the core metal, the core metal is liable to be softened, deforming the outer electrode at the time of welding the tip to the outer electrode. Moreover, the platinum tip tends to fall off the outer electrode when the spaced distance exceeds 2.0 mm. For these reasons in accordance with this invention the spaced distance set to be in the range 0.0–2.0 mm.

How these and other objects and advantages of this invention are achieved will be apparent upon reference to the accompanying specification, claims and drawings.

BRIEF DESCRIPTION OF THE DRAWINGS

FIG. 1 is a plan view of a spark plug, but partially longitudinally sectioned;

FIG. 1*a* is an enlarged fragmentary view of the tip end of FIG. 1;

DETAILED DESCRIPTION OF THE INVENTION

Figure 2:
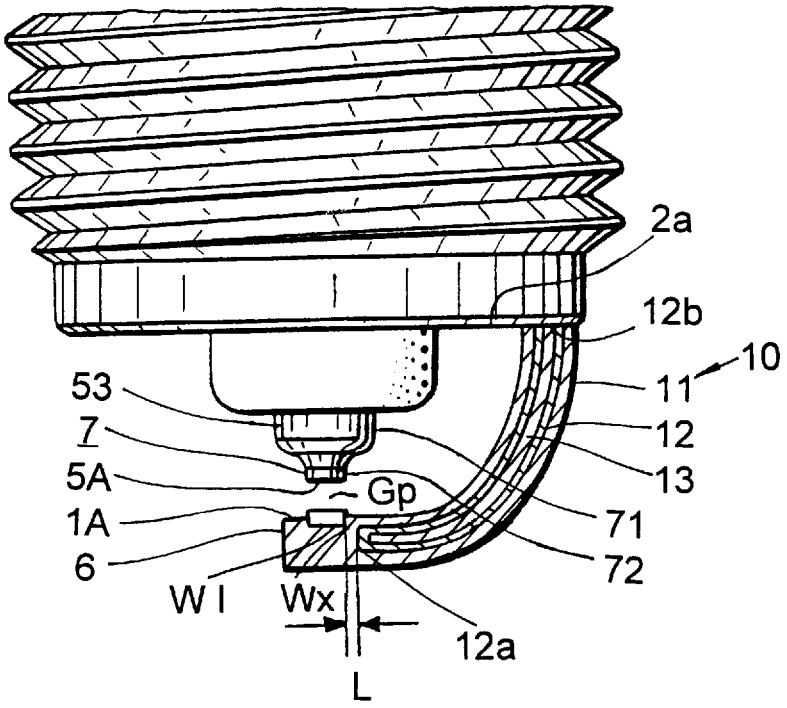
FIG. 2 is a fragmentary enlarged longitudinal cross sectional view of the outer electrode showing with a front end portion of the spark plug.

Referring to the spark plug shown in FIG. 1, there is provided a cylindrical metallic shell 2, to the front end of which an L-shaped outer electrode 1 is welded. Within the metallic shell 2, tubular insulator 3 is placed to provide an inner space or axial bore 31. Within axial bore 31 of insulator 3, a middle axis 4 is provided whose rear end has a terminal 41 to which a high tension line of an ignition circuit (not shown) is connected. To the front end of the middle axis 4, a glass sealant resistor 42 and a center electrode 5 are in turn connected in linear relationship with each other. Front end 5A of the center electrode 5 extends from the metallic shell 2 to oppose a front end 1A of the outer electrode 1 so as to form a spark gap (Gp) therebetween.

As shown, the spark plug forms an extension-type plug in which the front end 5A of the center electrode 5 extends from the metallic shell 2 by 1.5–15.0 mm so that the front end 5A projects into a combustion chamber (Ch) 3.0–17.0 mm when the spark plug is mounted in an internal combustion engine.

Outer electrode 1 consists a composite base metal 10 having a heat-conductive core metal 12 cladded with a nickel-alloyed matrix 11 which contains 10–20 wt. % chromium. To the front end 1A of the nickel-alloyed matrix 11, platinum tip 6 is welded at a position (WI) in a manner to oppose the front end 5A of the center electrode 5. It is noted that the tip 6 may contain 20 wt. % iridium (Ir).

The nickel-alloyed matrix 11 increases in oxidation resistance with the addition of chromium, while increasing hardness and reduced thermal conductivity. The nickel-alloyed matrix 11 containing chromium less than 10 wt. % causes a lowering of its oxidation resistance. These are reasons why the chromium content rate is desirably 10–20 wt. %.

The core metal 12 is made of copper, silver, copper-based alloy or silver-based alloy and has a front end 12*a* and a rear end 12*b*, the latter of which is placed in heat-transfer contact relationship with front end 2A of metallic shell 2.

In order to provide the composite base metal 10 with three-layer structure, core metal 12 clads innermost core 13 made of pure nickel or pure iron, thereby contributes to improving the weld at the outer electrode 1 to metallic shell 2, and at the same time, preventing the deformation of the outer electrode 1 due to the thermal heat-cool cycle of the internal combustion engine.

The welded portion (WI) of tip 6 is arranged to terminate slightly short of core metal 12, so that the spaced distance (L) between a circumferential edge (Wx) of the welded portion (WI) and the front end 12*a* of the core metal 12 falls within a range from 0.0 to 2.0 mm when measured along a lengthwise direction of the outer electrode 1, as shown in detail in FIGS. 1*a* and 2.

The nickel-alloyed matrix 11, which contains 10–20 wt. % chromium, is somewhat inferior in thermal conductivity, but superior in both high-temperature strength and oxidation-resistance compared to a nickel-alloyed outer electrode which usually contains more than 90 wt. % nickel. In order to compensate for thermal conductivity of the nickel-alloyed matrix 11, the front end 12*a* of the core metal 12 is terminated slightly short of the circumferential edge (Wx) of the welded portion (WI) within a range from 0.1 mm to 2.0 mm when measured along the lengthwise direction of the outer electrode. The spaced distance (L) makes it possible to avoid excessive temperature rise of the front end 1A of the outer electrode 1, thereby avoiding increased thermal stress from occurring at the welded portion (WI), thus keeping tip 6 in place.

In assembling the spark plug, the straight-type outer electrode is first welded to the metallic shell 2. Then, the insulator 3 is placed within the metallic sheet 2. Before bending the outer electrode 1 into the L-shaped configuration, tip 6 is secured to the outer electrode 1 by means of resistance welding. The copper or silver core 12 may soften and buckle under during the resistance welding when the circumferential edge (Wx) of the welded portion (WI) superposes the front end 12*a* of the core metal 12. This is a reason why the lower limit of the spaced distance (L) is determined to be 0.0 mm so as to prevent an overlapping relationship between the circumferential edge (Wx) of the welded portion (WI) and the front end 12 a of the core metal 12.

The center electrode 5 consists of a composite base metal 50 having copper core 51 cladded by a nickel-alloyed matrix 52 which contains more than 90 wt. % nickel. To the front end of the composite base metal 50, nickel-alloy layer 53 which contains 20–25 wt. % chromium is secured by resistance welding. To the front end of the nickel-alloy layer 53, platinum tip 7 is secured by means of resistance welding. Platinum tip 7 has an increased diameter portion 71 welded to the nickel-alloyed layer 53, and has a reduced diameter portion 72 opposite platinum tip 6 through spark gap (Gp).

It is to be noted that the outer configuration of the nickel-alloy layer 53 and platinum tip 7 may be shaped after carrying out the resistance welding in order to prevent their deformation during the welding operation. Also, to be noted, nickel-alloy layer 53 may be omitted and platinum tip 7 may be welded directly to a front end of the reduced diameter portion of the nickel alloy matrix 52, instead of the nickel-alloy layer 53.

Figure 3:
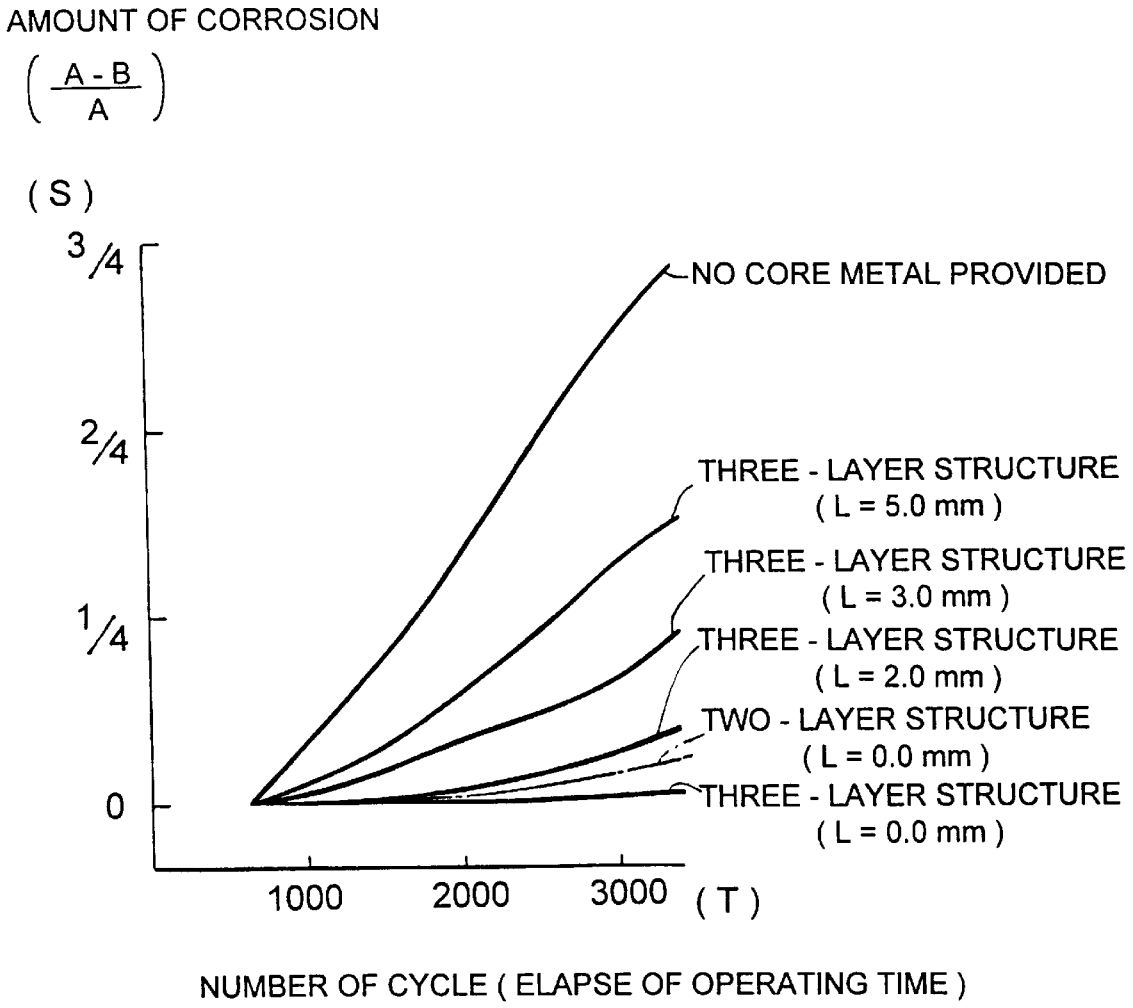
FIG. 3 is a graph showing how an amount of corrosion (S) changes with an elapse of operating time (T) and a spaced distance (L)

FIG. 3 is a graph showing how the amount of corrosion (S) of the welded portion (WI) changes with operating time (T) and the spaced distance (L) as observed in an endurance experiment with the spark plug in a four-cylinder, 2000 cc, four-cycle internal combustion engine which as an alternately operated idling and full throttle during the heat-cool cycle.

Figure 3A:
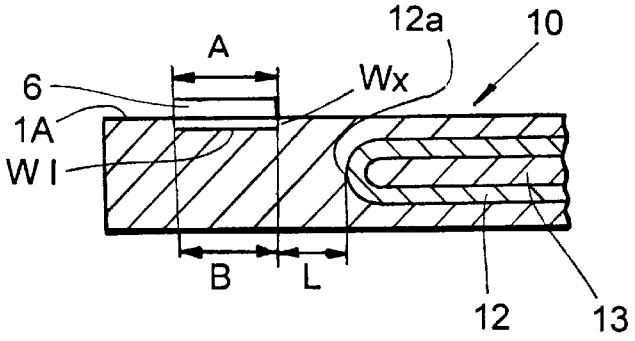
FIG. 3*a* is a partly broken view of the outer electrode to show the axial length (A) of a platinum tip and an axial length (B) of a welded portion.

FIG. 3*a* shows a partly broken away outer electrode 1 to show an axial length (A) of the platinum tip 6 and an axial length (B) of the welded portion (WI). The amount of corrosion (S) of the welded portion (WI) is expressed by (A-B)/A. The above-described experiments showed that rapid corrosion occurs at the welded portion (WI) in those cases where the spaced distance is 5.0 mm or 3.0 mm, with the innermost core 13 provided in the core metal 12 to form the three-layer structure, and in the case when no core metal is provided. It was also found that only a small amount corrosion (S) occurs at the welded portion (WI), but the outer electrode is subjected to an unfavorable deformation when the spaced distance is 0.0 mm with no innermost core provided in the core metal 12 to a two-layer structure. It is, however, to be understood that only a small amount of corrosion (S) occurs at the welded portion (WI) when the spaced distance is kept within the range 0.0 mm–2.0 mm. It is moreover understood that the invention is not restricted to the extension-type spark plug in which the center electrode 5 projects into the combustion chamber (Ch).

In support of the advantages and the operability of the practices of this invention, tests were carried out where the tests were designed to demonstrate the practices of this invention and the benefits obtainable therefrom.

Specifically, the tests were carried out in order to demonstrate the significance of the distance in the range 0–2 mm in accordance with this invention. These tests were conducted also to confirm the relationship between temperature rise of the Pt-based tip and deformation or buckling of the ground electrode, by changing the distance L between the front end of the core metal which enters the ground electrode, as shown in FIG. 1 of the drawings.

Figure 4:
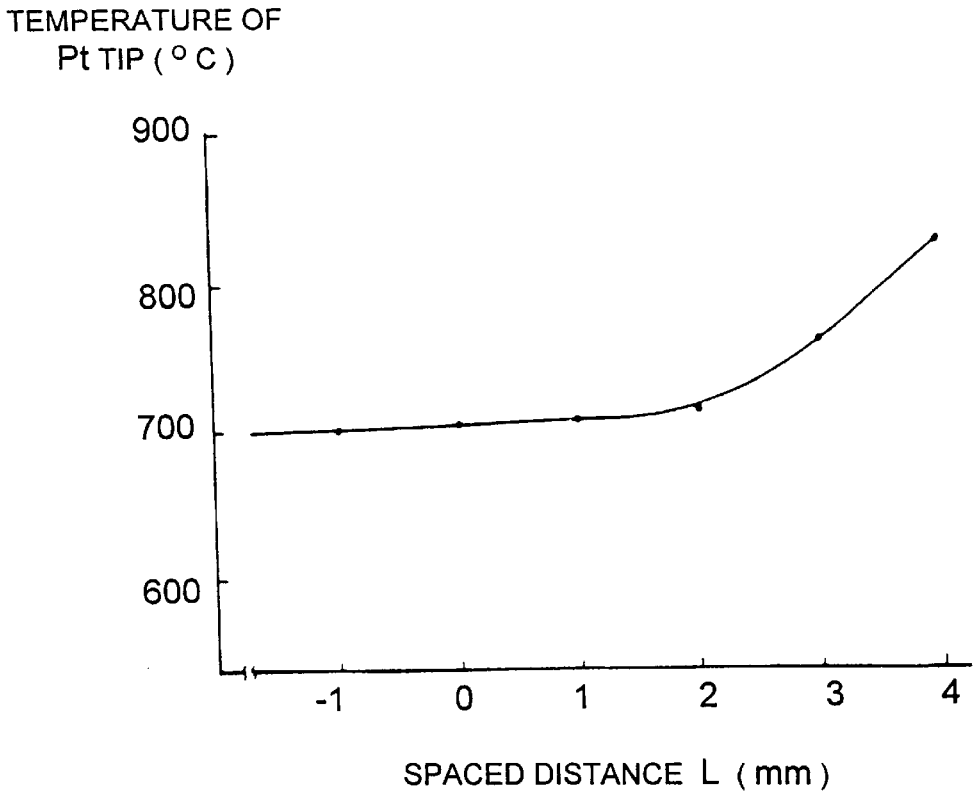
FIG. 4 graphically represents the influence of spaced distance upon the temperature of the platinum tip.

The experimental test results illustrated in accompanying FIG. 4 were obtained by installing a spark plug on a support bed which has the same type of cooling as provided on a cylinder head. The outer end of the ground electrode was heated by a burner and the temperature of the Pt-based tip measured.

After the Pt-based tip was secured to the upper side of the ground electrode, the tests were conducted to confirm the occurrence of deformation or buckling of the matrix metal by changing the distance L between the front end of the core metal and the circumferential end of the Pt-based tip.

In the tests, it was possible to maintain the temperature of the Pt-based tip when the distance L is in the range −1–2 MM. In accompanying FIGS. 4 and 5 of the drawings the spaced distance of −1 mm means that the front end of the core metal overlaps with the Pt-based tip. It is apparent that the low temperature of the Pt-based tip makes it possible to decrease thermal stress in the matrix metal and at the same time improve the oxidation resistance to better present the Pt-based tip from inadvertently falling off the matrix metal.

Figure 5:
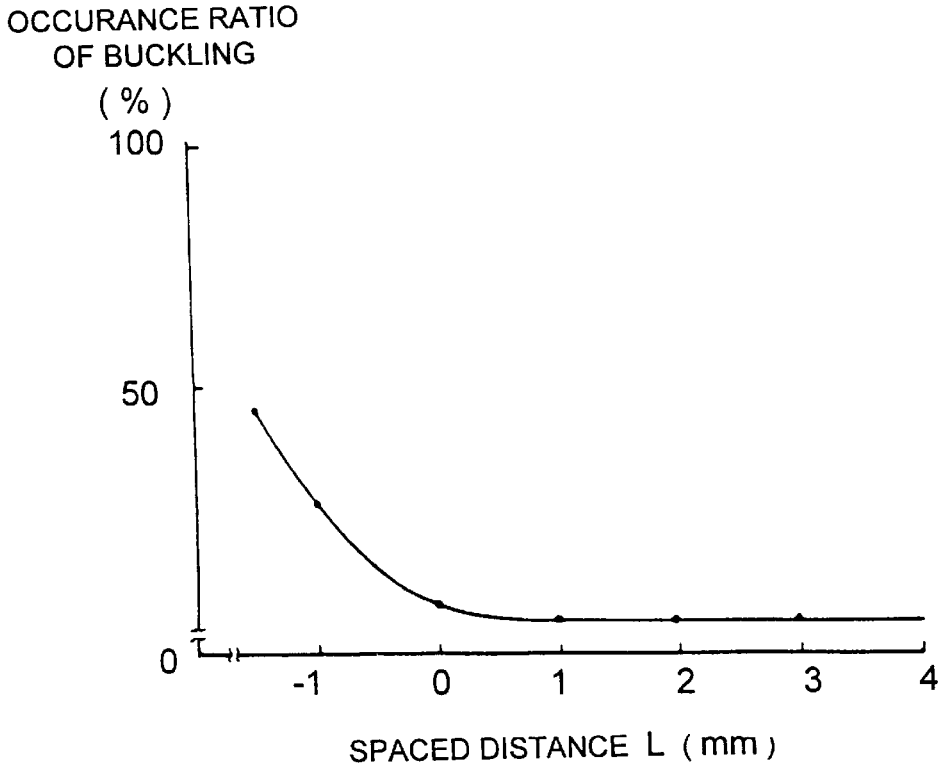
FIG. 5 graphically represents an influence of spacing upon buckling.

Also, see accompanying FIG. 5, buckling is likely to occur when the front end of the core metal partly overlaps the Pt-based tip, as indicated at the distance −1 mm. With increase of distance L, it was surprisingly found that the buckling is unlikely to occur when L=0 mm. The distance L in the range 0–2 mm is a very practical value and it will be appreciated from FIGS. 4 and 5 that the distance L is usefully in the range 0.1–2 mm to produce the desired and sought for results. It is further to be understood that the invention is not restricted to the extension-type spark plug wherein the center electrode 5 projects into the combustion chamber (Ch).

While the invention has been described with reference to specific embodiments, it is to be understood that the description is not in a limiting sense especially since many operative modifications of this invention may be made on the light of this disclosure without departing from the spirit ot scope of this invention.

What is claimed is:

1. In a spark plug comprising a center electrode disposed in a metallic shell through an insulator, a front end of the center electrode being made of platinum or a platinum-based alloy and forming a spark gap with an outer electrode extended from the metallic shell, and wherein a platinum tip which is secured to the outer electrode in a manner to oppose the front end of the center electrode through the spark gap;

the improvement comprising:

providing the outer electrode with a heat-conductive core metal clad by a matrix metal made from a nickel-based alloy containing 10–20 wt. % chromium; and welding the platinum tip to the outer electrode in a manner to form a welded portion between the tip and the outer electrode; wherein the platinum tip is positioned to terminate slightly short of the core metal so that the distance between a circumferential edge of the welded portion and a front end of the core metal is in the range from 0.0 mm to 2.0 mm measured along a lengthwise direction of the outer electrode;

the core metal being made of a metal selected from the group consisting of copper, silver, copper-based alloy and silver-based alloy; and the front end of the center electrode extending from the metallic shell by 1.5 to 15.0 mm so as to project by 3.0 to 17.0 mm into a combustion chamber of an internal combustion engine.

2. A spark plug as recited in claim 1 wherein an innermost core is provided clad by the core metal, the innermost core being made from pure nickel or pure iron.

3. A spark plug as recited in claim 1 wherein the platinum tip contains 20 wt % iridium.

4. A spark plug as recited in claim 1 wherein a spark endurance of the welded portion is improved in terms of an expression (A-B)/A, where A is a length of the platinum tip secured to the outer electrode through the welded portion and B is a length of the welded portion.

5. A spark plug as recited in claim 1 wherein the center electrode comprises:

a composite base metal having a copper core clad by a nickel-alloy matrix, the matrix containing more than 90 wt. % nickel and having a front end having a nickel-alloy layer, the nickel-alloy layer having a front end, further comprising a platinum tip attached to the front end of the nickel-alloy layer, the platinum tip attached to the front end of the nickel-alloy layer having an increased diameter portion welded to the nickel-alloy layer and a reduced diameter portion opposed through the spark gap to the platinum tip of the outer electrode.

* * * * *